United States Patent [19]

Iwai et al.

[11] Patent Number: 4,968,162

[45] Date of Patent: Nov. 6, 1990

[54] RIBBON FORWARDING APPARATUS OF IMPACT TYPE PRINTER

[75] Inventors: Horoji Iwai; Atsushi Kadoya, both of Yamatokoriyama, Japan

[73] Assignee: Sharp Corporation, Osaka, Japan

[21] Appl. No.: 363,459

[22] Filed: Jul. 28, 1989

Related U.S. Application Data

[63] Continuation of Ser. No. 130,770, Dec. 9, 1987, abandoned.

[30] Foreign Application Priority Data

Dec. 12, 1986 [JP] Japan ..... 61-192072

[51] Int. Cl.[5] ..... B41J 33/18

[52] U.S. Cl. ..... 400/232; 400/236.1; 400/697.1

[58] Field of Search ..... 400/211, 213, 223, 225, 400/227, 227.2, 231, 232, 240.1, 236.1, 697.1

[56] References Cited

U.S. PATENT DOCUMENTS

| | | | |
|---|---|---|---|
| 3,114,447 | 12/1963 | Wolowitz | 400/240.1 |
| 4,247,210 | 1/1981 | Kacmarcik et al. | 400/236.1 |
| 4,329,072 | 5/1982 | Kacmarcik | 400/236.1 X |
| 4,611,938 | 9/1986 | Rettke et al. | 400/232 X |

FOREIGN PATENT DOCUMENTS

| | | | |
|---|---|---|---|
| 0031280 | 2/1986 | Japan | 400/232 |
| 2161756 | 1/1986 | United Kingdom | 400/232 |

OTHER PUBLICATIONS

Sweet, M. D. and Toutant, E. E., "Reduced Consumption of Ribbon on An Impact Printer", IBM Technical Disclosure Bulletin, vol. 23, No. 8, (Jan. 1981), p. 3506.

Soviet Inventions Illustrated, Sections P, Q, week 8810, Apr. 20, 1988, Derwent Publications Ltd., London, P75, SU 1326-457-A (Kirovograd Pishmash).

*Primary Examiner*—Edgar S. Burr

*Assistant Examiner*—Moshe I. Cohen

*Attorney, Agent, or Firm*—David G. Conlin; Robert M. Asher

[57] ABSTRACT

Disclosed is a ribbon forwarding apparatus of impact type printer for printing on a recording paper wound on a platen by moving printing means disposed at a specified position of a carrier which moves along this platen to the printing position, and striking it by way of an ink ribbon, comprising, an elevation table which is mounted on said carrier, has an ink ribbon cartridge and a correction tape cartridge mounted on the upper and lower parts thereof, and is moved up and down to position the ink ribbon at said printing position when printing and the correction tape when erasing, a ratchet wheel which is mounted on this elevation table and drives to selectively change over the ink ribbon feed in printing and ink ribbon feed in erasing, a slider which is mounted on said elevation table and has a feed pawl engaged with said ratchet wheel; and a rocker arm which is perpendicularly disposed on said carrier with one end pivoted on and moves said slider reciprocally, wherein said rocker arm is disposed so that the abutting point of said slider and rocker arm may be shifted to the pivoting point side of this rocker arm along with the movement of said elevation table when erasing to set the feed of the ink ribbon in erasing smaller than the feed of the ink ribbon in printing.

6 Claims, 1 Drawing Sheet

RIBBON FORWARDING APPARATUS OF IMPACT TYPE PRINTER

This is a continuation of co-pending application Ser. No. 07/130,770 filed on Dec. 9, 1987, abandoned.

BACKGROUND OF THE INVENTION

This invention relates to a ribbon forwarding apparatus of impact type printer for printing on a recording paper wound on a platen by moving printing means disposed at a specified position on a carrier which moves along this platen to a printing position, and striking it through an ink ribbon at the printing position.

Conventionally, as a ribbon forwarding apparatus of impact type printer of this sort, for example, the structure as shown in FIG. 3 was known. This ribbon forwarding apparatus is elevatably mounted on a carrier which possesses a printing unit and moves along a platen, a ratchet wheel 22 threaded in pitch C corresponding to the feed rate of the ink ribbon is pivoted on a lower face 21 of an elevation table having an ink ribbon cartridge and a correction ribbon cartridge mounted in its upper and lower faces, and there are a feed pawl 23 which is engaged with this ratchet wheel and a slider 24 which is reciprocally moved in the direction of arrow A in synchronism with the printing speed by drive means (not shown), in which the ratchet wheel 22 is rotated in the direction of arrow B by one pitch each, that 1, $\theta c°$, by the reciprocal motion of the slider 24 so as to forward the ink ribbon intermittently when printing. When erasing, on the other hand, the elevation table ascends to position the correction tape at the printing unit, and as the printing unit strikes the recording paper on the platen by way of this correction tape, the ink on the recording paper is picked up by the correction tape and is erased.

In this erasing action, it is not always necessary to forward the ink ribbon, but if the tape forwarding is null, when continuously erasing multiple letters, the ribbon may be loosened by vibrations to stick to the daisy wheel, or perfect transfer of the ink into the recording medium may not be achieved when printing.

However, in said conventional ribbon forwarding apparatus, although forwarding of ink ribbon in erasing action is enough by a small amount necessary for preventing its looseness, the ink ribbon was actually forwarded in the erasing action by the same amount of the feed of the ink ribbon in printing action, the ink ribbon was wasted by the purposeless forwarding more than necessary for prevention of the loosening of the ribbon in erasing action.

SUMMARY OF THE INVENTION

It is hence a primary object of this invention to present a ribbon forwarding apparatus of impact type printer capable of forwarding the ink ribbon by a smaller feed in erasing action than the feed of the ink ribbon in printing action so as to eliminate waste of the ink ribbon in a simple and inexpensive structure.

Briefly described, in accordance with the present invention, is a ribbon forwarding apparatus of impact type printer for printing on a recording paper wound on a platen by moving printing means disposed at a specified position on a carrier which moves along this platen to a printing position, and striking it through an ink ribbon at the printing position, comprising, in order to achieve the above and other objects, an elevation table which is mounted on said carrier and has an ink ribbon cartridge and a correction tape cartridge mounted on its upper and lower faces, and moves up and down to position the ink ribbon at said printing position when printing and the correction tape at said printing position when erasing, a ratchet wheel which is mounted on this elevation table and is driven to selectively change over the feed of the ink ribbon in printing motion and the feed of the ink ribbon in erasing motion, a slider which is mounted on said elevation table and has a feed pawl to be engaged with said ratchet wheel, and a rocker arm which is perpendicularly pivoted on said carrier at one end to move said slider reciprocally, wherein said rocker arm is disposed so that the abutting point of said slider and rocker arm may be shifted to the pivoting point side of this rocker arm along with the movement of said elevation table when erasing in order that the feed of the ink ribbon in erasing action may be smaller than the feed of the ink ribbon in printing action.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENT

This invention is described below in details by referring to an illustrated embodiment.

Figure 1:
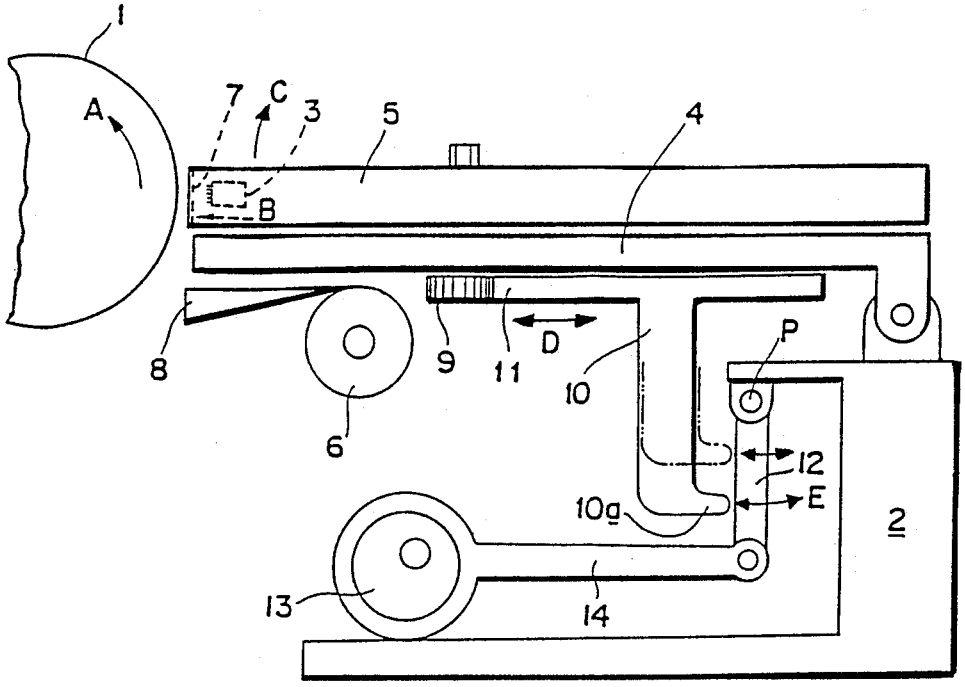
FIG. 1 is a schematic side elevation of an impact type printer having a ribbon forwarding apparatus of this invention.

FIG. 1 is a schematic side elevation of an impact type printer having a ribbon forwarding apparatus of this invention, in which numeral 1 is a platen which is stretched horizontally with a recording paper wound on the outer circumference thereof and is driven and rotated in the direction of arrow A along with printing, 2 is a carrier which is driven reciprocally in the vertical direction on the paper surface in the drawing along the platen 1, 3 is a printing device which is driven in the direction of arrow B to print being disposed on this carrier 2 opposite to said platen 1, and 4 is an elevation table which is mounted on said carrier 2 with its rear end being pivoted, has an ink ribbon cartridge 5 and a correction tape cartridge 6 mounted on the upper face and lower face thereof respectively, and is inclined in the direction of arrow C when erasing so as to position the correction tape 8 at the front side of said printing device 3.

Numeral 9 is a ratchet wheel which is disposed on the lower face of this elevation table 4 and feeds and drives the ink ribbon 7 selectively in two steps depending on printing and erasing motion, 10 is a slider which is slidably (see arrow D) mounted on the lower face of said elevation table 4, having a feed pawl 11 (see FIG. 2) engaging with this ratchet wheel 9 at its end, 12 is a rocker arm which is perpendicularly disposed to abut against the lower protuberance 10*a* of said slider, with its upper end pivoted on said carrier 2, 13 is a disc crank which is disposed in said carrier 2 to be driven and rotated at a speed corresponding to the printing speed, and 14 is a connecting rod which oscillates said rocker arm 12 in a specified amplitude as indicated by arrow E, with one end pinned to this disc crank 13 and the other end pinned to said rocker arm.

Figure 2:
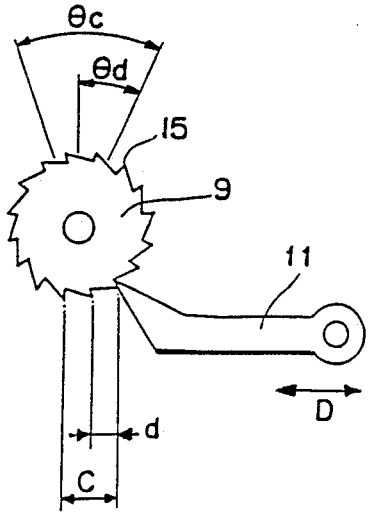
FIG. 2 is a plan showing the engaged state of ratchet wheel and feed pawl.
Figure 3:
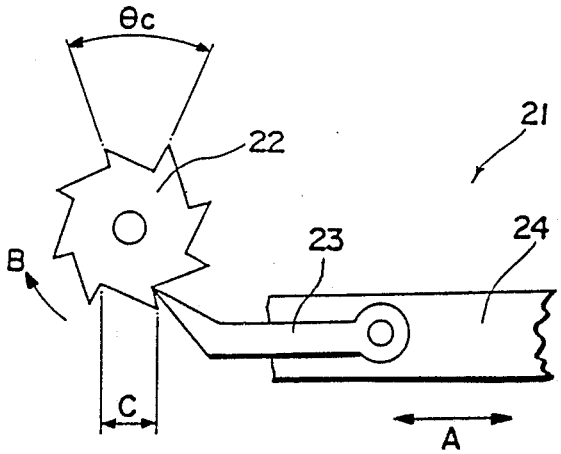
FIG. 3 is a plan showing principal parts of a conventional ribbon forwarding apparatus.

FIG. 2 shows the engaged state of said ratchet wheel 9 and feed pawl 11, in which 16 ratchet teeth 15 are disposed on the outer circumference of the ratchet wheel 9 at a pitch d corresponding to the minimum feed of the ink ribbon. This pitch d is equal to the stroke of said slider 10 which is moved reciprocally by the rocker arm 12 when the lower protuberance 10*a* of the slider 10 abuts against the rocker arm 12 at the position indicated by double dot chain line in FIG. 1. On the other hand, in the printing state shown in FIG. 1, the lower protuberance 10*a* of the slider 10 abuts against the rocker arm 12 at a position at a double distance of the above from its pivoting point P, and it is structured so that the stroke of the slider 10 may be c or double the pitch d.

Thus composed ribbon forwarding apparatus operates as follows.

When printing, the elevation table 4 is in the state as shown in FIG. 1, and the ink ribbon 7 is positioned before the printing device 3. The lower protuberance 10*a* of the slider 10 mounted on the elevation table 4 abuts against the oscillation end side of the rocker arm 12, and the slider 10 moves reciprocally at a stroke of $c=2d$ as stated above, and is engaged with the ratchet wheel 9 on every other tooth to rotate it by $\theta c°$ (45°) each, so that the ink ribbon 7 is forwarded intermittently at the printing feed. The printing device 3 strikes the recording paper on the platen 1 through said ink ribbon 7 which stops intermittently to print sequentially. Next, when erasing, the elevation table 4 is tilted in the direction of arrow C, and the correction tape 8 is positioned before the printing device 3. The lower protuberance 10*a* of the slider 10 of elevation table 4 moves its abutting point to the vicinity of pivoting point P of the rocker arm 12, and the slider 10 reciprocates at stroke d as mentioned above, and is engaged with the ratchet wheel 9 on every tooth to rotate it by $\theta d°$ (22.5°) each, so that the ink ribbon 7 is intermittently forwarded at feed of ½ of printing motion. The printing device 3 strikes the printed recorded paper on the platen through said correction tape 8 which stops intermittently to erase sequentially.

Thus, in this embodiment, when erasing, the ink ribbon is forwarded at half feed of printing, and the consumption of the ink ribbon may be saved while preventing looseness of the ink ribbon and transferring the ink perfectly on the printing medium when printing.

In the embodiment, meanwhile, the forwarding speed of the ink ribbon in erasing motion is ½ that of the ink ribbon in printing motion, but by varying the pitch of the ratchet wheel teeth and the ratio of the distance from the pivoting point of the abutting point of the slider abutting against the rocker arm when printing and erasing, the forwarding speed of the ink ribbon in erasing motion may be set at $1/n$ ($n=3, 4, \ldots$) that of the ink ribbon in printing motion.

Thus, according to this invention, many benefits are brought about.

For example, it is supposed that an ink ribbon cartridge is mounted on the upper part of the elevation table and a correction tape cartridge on the lower part thereof. When printing, said elevation table is at the lowest limit having the ribbon positioned at the printing point disposed at specified position of the carrier, and the slider mounted on this elevation table is reciprocated at a large amplitude, abutting against the oscillation end side of the rocker arm. The feed pawl of the slider is engaged with the ratchet wheel on every specified number of teeth by this reciprocal motion to rotate it, and the ink ribbon is forwarded by the feed amount corresponding to said number of teeth. The printing means strikes the platen through said ink ribbon which stops intermittently to print sequentially. When erasing, said elevation table ascends to the upper limit to position the correction tape to the printing point, and accordingly the slider on the elevation table moves its abutting point to the vicinity of the pivoting point of the rocker arm so as to be reciprocated at small amplitude. Accordingly, the feed pawl of the slider is engaged with the ratchet wheel on every tooth to rotate it, and the ink ribbon is intermittently forwarded by a smaller amount than when printing. The printing means strikes the printed recording paper on the platen through said correction tape which stops intermittently to erase sequentially.

As clear from the description above, the ribbon forwarding apparatus according to this invention of an impact type printer for printing on a recording paper wound on a platen by moving printing means disposed at a specified position of a carrier which moves along this platen to the printing position, and striking it by way of an ink ribbon comprises an elevation table which is mounted on said carrier, has an ink ribbon cartridge and a correction tape cartridge mounted on the upper and lower parts thereof, and is moved up and down to position the ink ribbon at said printing position when printing and the correction tape when erasing, a ratchet wheel which is mounted on this elevation table and drives to selectively change over the ink ribbon feed in printing and ink ribbon feed in erasing, a slider which is mounted on said elevation table and has a feed pawl engaged with said ratchet wheel, and a rocker arm which is perpendicularly disposed on said carrier with one end pivoted on and moves said slider reciprocally, wherein said rocker arm is disposed so that the abutting point of said slider and rocker arm may be shifted to the pivoting point side of this rocker arm along with the movement of said elevation table when erasing to set the feed of the ink ribbon in erasing smaller than the feed of the ink ribbon in printing, so that the consumption of ink ribbon may be saved while preventing looseness of ink ribbon as experienced when there is no tape feed at all, thus avoiding troubles, and also transferring the ink perfectly on the recording medium.

While only certain embodiments of the present invention have been described, it will be apparent to those skilled in the art that various changes and modifications may be made therein without departing from the spirit and scope of the present invention as claimed.

What is claimed is:

1. A carrier assembly for use in an impact type printer comprising:

an ink ribbon;

a correction tape;

a printing device for striking against said ink ribbon to print or against said correction tape to erase;

means for selectively positioning either one of said ink ribbon and said correction tape in position for striking by said printing device;

a ratchet wheel coupled to said ink ribbon so that rotation of said ratchet wheel causes said ribbon to feed, said ratchet wheel having a series of teeth projecting radially therefrom;

a slider which engages the teeth of said ratchet wheel; and means for moving said slider reciprocally to intermittently engage said ratchet wheel so as to feed the ink ribbon at a first feed rate when printing and at a second feed rate greater than zero and slower than the first feed rate when erasing.

2. The carrier assembly of claim 1 wherein said selectively positioning means comprises an elevation table and said ink ribbon and correction tape are mounted on different parts thereof.

3. The carrier assembly of claim 1 wherein said means for moving causes said slider to reciprocate to intermittently engage said ratchet wheel on every nth tooth, where n is an integer greater than one, when printing and every tooth when erasing.

4. The carrier assembly of claim 3 wherein n equals two.

5. The carrier assembly of claim 6 wherein said means for moving said slider comprises a rocker arm which is oscillated at a speed corresponding to the striking speed of said printing device, wherein said slider abuts said rocker arm in one position when said ink ribbon is in position for striking by said printing device and in a second position when said correction tape is in position for striking by said printing device.

6. A carrier assembly for use in an impact type printer comprising:

a carrier base;

an elevation table mounted on said carrier base so as to be movable between a printing position and an erasing position;

an ink ribbon cartridge mounted on one part of said elevation table;

a correction tape cartridge mounted on a second part of said elevation table;

a printing device disposed for striking said ink ribbon when said elevational table is in said printing position and for striking said correction tape when said elevation table is in said erasing position;

a ratchet wheel mounted on said elevation table and coupled to said ink ribbon cartridge so that rotation of said ratchet wheel causes said ribbon to feed;

a slider mounted on said elevation table, having a feed pawl which engages said ratchet wheel such that reciprocating movement of said slider causes said ratchet wheel to rotate;

a rocker arm having one end pivoted on said carrier base, wherein said rocker arm is disposed so that said slider abuts said arm at one point when said elevation table is in said printing position to reciprocate said slider a first distance and so that said slider abuts said arm at a second point closer to said one end when said elevation table is in said erasing position to reciprocate said slider a second distance shorter than said first distance.

* * * * *